US005092502A

United States Patent [19]

Kolton et al.

[11] Patent Number: 5,092,502

[45] Date of Patent: Mar. 3, 1992

[54] HANGER FOR THIN GARMENTS WITH DIVERSELY SIZED PROSECTIONS FOR GRIPPING

[75] Inventors: Chester Kolton, Westfield; Stuart S. Spater, Livingston, both of N.J.

[73] Assignee: A & E Products Group, Woodbridge, N.J.

[21] Appl. No.: 580,853

[22] Filed: Sep. 11, 1990

[51] Int. Cl.[5] ..... A47G 25/48; A47G 25/14

[52] U.S. Cl. ..... 223/91; 223/85; 223/96; D6/315

[58] Field of Search ..... 223/96, 95, 93, 90, 223/85, 88, 92, 91; D6/315, 326; 211/113

[56] References Cited

U.S. PATENT DOCUMENTS

| | | | |
|---|---|---|---|
| 2,554,825 | 5/1951 | Grimberg | 223/90 X |
| 2,828,898 | 4/1958 | Hulett | 223/96 |
| 3,738,549 | 6/1973 | Driscoll | 223/85 |
| 4,223,817 | 9/1980 | Hazenfeld | 223/96 |
| 4,295,585 | 10/1981 | Garrison | 223/96 |
| 4,623,079 | 11/1986 | Tendrup et al. | 223/85 |
| 4,828,155 | 5/1989 | Louw et al. | 223/85 |
| 4,892,237 | 1/1990 | Duester et al. | 223/85 |

FOREIGN PATENT DOCUMENTS

| | | | |
|---|---|---|---|
| 1514978 | 6/1978 | United Kingdom | 223/96 |
| 2120542 | 12/1983 | United Kingdom | 223/96 |

*Primary Examiner*—Werner H. Schroeder
*Assistant Examiner*—Bibhu Mohanty
*Attorney, Agent, or Firm*—Blum Kaplan

[57] ABSTRACT

A hanger is comprised of an integral body or snythetic material having a central portion, a hook portion extending outwardly of the central portion and first and second wing portions at respective opposed side margins of the central portion. The central portion defines, at each side margin thereof, a succession of diversely-sized projections extending outwardly of the side margins, the projections being of generally arcuate configuration and each of successively lesser size progressively distal of the hook portion. Each wing portion comprises a member cantilever-supported by the central portion, each such cantilever-supported member defining mutually with the projections, spacings of successively lesser measure progressively distal of the hook portion.

14 Claims, 3 Drawing Sheets

HANGER FOR THIN GARMENTS WITH DIVERSELY SIZED PROSECTIONS FOR GRIPPING

FIELD OF THE INVENTION

This invention relates generally to lingerie hangers and pertains more particularly to improved hangers for panties.

BACKGROUND OF THE INVENTION

A wide variety of panty hangers are presently known to comprise an integral plastic frame having a hook portion and a body portion, the latter having generally horizontally extending wing portions. Each wing portion has a gripping finger structure at its free end. Examples of such hangers are seen in U.S. Pat. Nos. 3,738,549 and 4,623,079.

From applicants, perspective, known panty hangers exhibit less than desired gripping finger structure. Thus, the hanging function is in the vertical plane of the hangers and depends, in the prior art structures on frictional engagement of the panty waistband and the finger structure, arising from the elasticity of the waistband and the strength of the gripping structure. Additional retention function would evidently be desirable.

SUMMARY OF THE INVENTION

The present invention has as its primary object the provision of improved lingerie hangers.

A more particular object of the invention is to provide panty hanger gripping finger structure having enhanced capacity for retention of panties.

In attaining the foregoing and other objects, the invention provides a hanger comprised of an integral body of synthetic material having a central portion, a hook portion extending outwardly of the central portion and first and second wing portions at respective opposed side margins of the central portion, the central portion defining, at each side margin thereof, a succession of diversely-sized projections extending outwardly of the side margins, the projections being of generally arcuate configuration and each of successively lesser size progressively distal of the hook portion. Each wing portion comprises a member cantilever-supported by the central portion, each such cantilever-supported member defining mutually with the projections spacings of successively lesser measure progressively distal of the hook portion.

Preferably, the succession of diversely-sized projections includes a first and a second projection, the first projection being of generally semi-circular configuration outwardly of the side margins, the second projection being generally of configuration comprising a sector of a circle substantially less than a semi-circle.

The foregoing and other features of the invention will be further understood from the following detailed description of a preferred embodiment thereof and from the drawings wherein like reference numerals identify like components and parts throughout.

DESCRIPTION OF THE PREFERRED EMBODIMENTS AND PRACTICES

Figure 2:
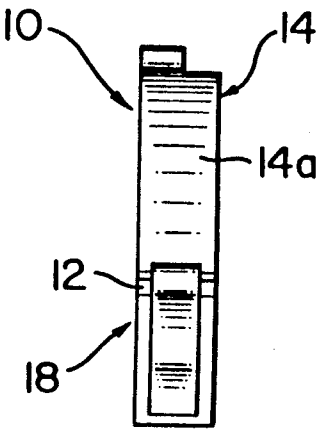
FIG. 2 is a right side elevation of the FIG. 1 hanger.
Figure 1:
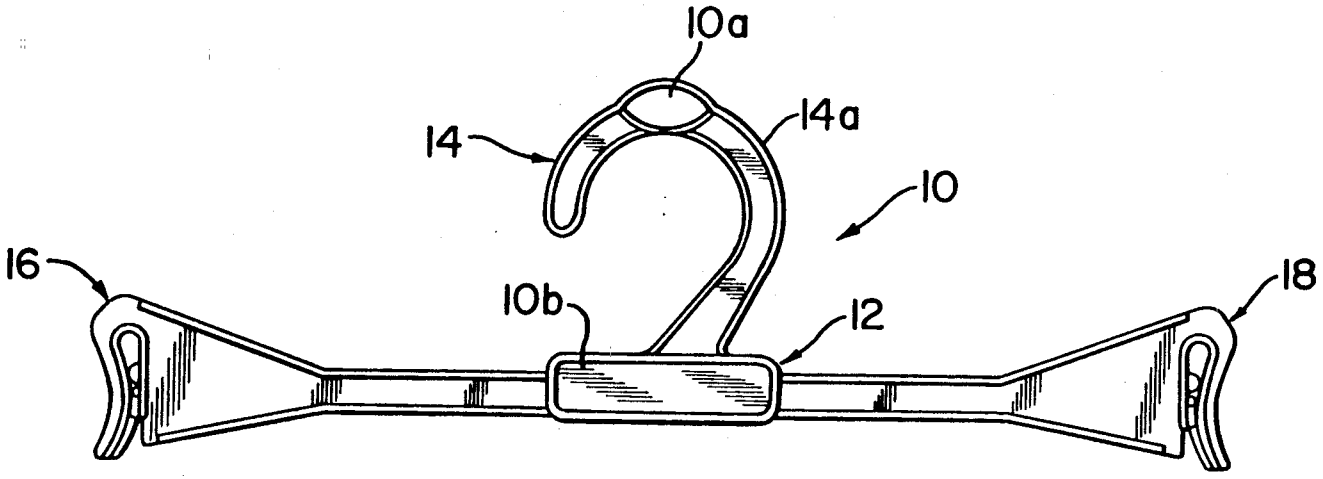
FIG. 1 is a front elevation of a first embodiment of a hanger in accordance with the invention.
Figure 3:
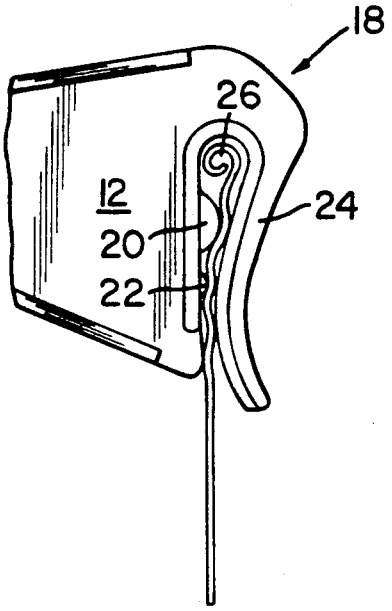
FIG. 3 is an enlarged view of a first embodiment of the finger gripping structure at the rightward end of the FIG. 1 hanger.

Referring to FIGS. 1-3, accessory hanger 10 is comprised of an integral body of synthetic material having a central portion 12, a hook portion 14 extending outwardly of central portion 12 and first and second wing portions 16 and 18 at respective opposed side margins of central portion 12. The central portion defines, at each side margin thereof, a succession of diversely-sized projections extending outwardly of the side margins. Considering the rightward side margin of central portion 12, projections 20 and 22 are of generally arcuate configuration outwardly of the side margins and of successively lesser size progressively distal of hook portion 14. In the first embodiment under discussion, projection 20 approximates a semi-circle, while projection 22 is a sector of a circle substantially less than a semi-circle.

Wing portions 16 and 18 each comprise a member cantilever-supported by the central portion. Considering wing portion 18, cantilever-supported member 24 defines mutually with projections 20 and 22 spacings of successively lesser measure progressively distal of hook portion 14.

As is seen in the enlarged partial view of FIG. 3, wherein panty 26 is shown supported by wing portion 18, panty 26 is found to bunch up in the upper area of the wing portion, based on the interaction of cantilever-supported member 24 and projections 20 and 22 as the panty is inserted into the wing portion. Projection 20 thereupon acts as an impediment to movement of the bunched up panty part downwardly and outwardly of the wing portion. Further retention is derived by the pinching action of member 24 and projections 20 and 22 on the panty.

As illustrated in FIG. 1, hanger 10 is desirably reinforced, as by having thickened margins, as is indicated at **14*a* for hook portion 14. Logo/size display areas are provided at 10*a* and 10*b***.

Figure 4:
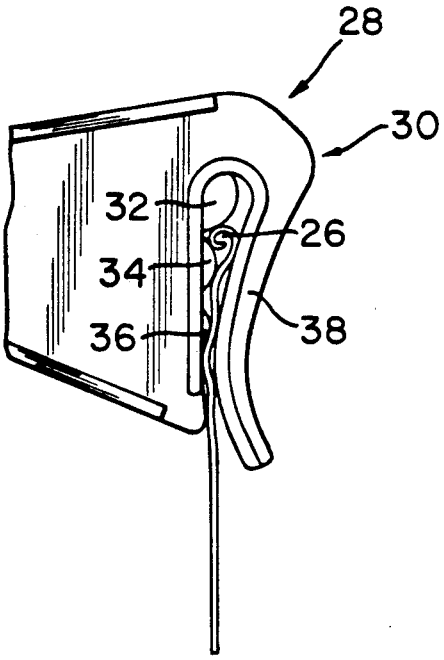
FIG. 4 is an enlarged view of a second embodiment of the finger gripping structure at the rightward end of the FIG. 1 hanger.

A second embodiment of the invention is shown in FIG. 4. Hanger 28 has wing portions, one being shown at 30, which differ from the wing portions of the first embodiment in including a set of three projections. Considering wing portion 30, projections 32, 34 and 36 are of generally arcuate configuration outwardly of the side margin, and of successively lesser size progressively distal of hook portion 14. In this second embodiment under discussion, projection 32 is in excess of a semi-circle, projection 34 approximates a semi-circle, while projection 36 is a sector of a circle substantially less than a semi-circle.

Cantilever-supported member 38 defines mutually with projections 32 34 and 36 spacings of successively lesser measure progressively distal of hook portion 14.

As is seen also in the enlarged partial view of FIG. 4, wherein panty 26 is shown supported by wing portion 30, panty 26 is found to bunch up in the upper area of the wing portion, based on the interaction of cantilever-supported member 38 and projections 32, 34 and 36 as the panty is inserted into the wing portion. Projections 34 and 36 thereupon act as impediments to movement of the bunched up panty part downwardly and outwardly of the wing portion. Further retention is derived by the pinching action of member 38 and projections 32, 34 and 36 on the panty.

Figure 6:
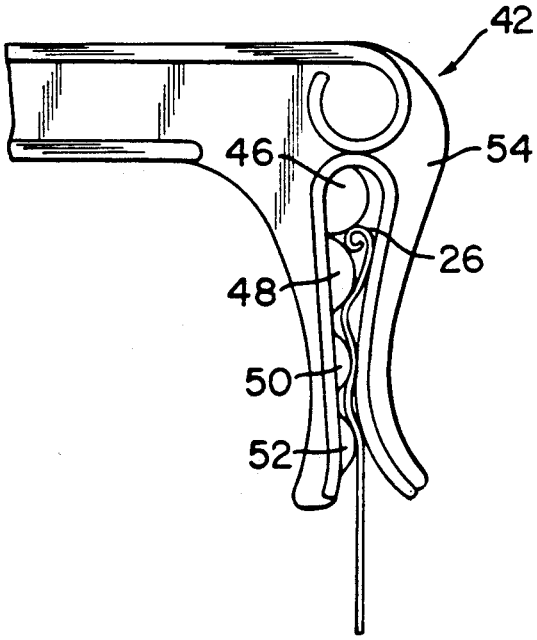
FIG. 6 is an enlarged view of the finger gripping structure at the rightward end of the FIG. 5 hanger.
Figure 5:
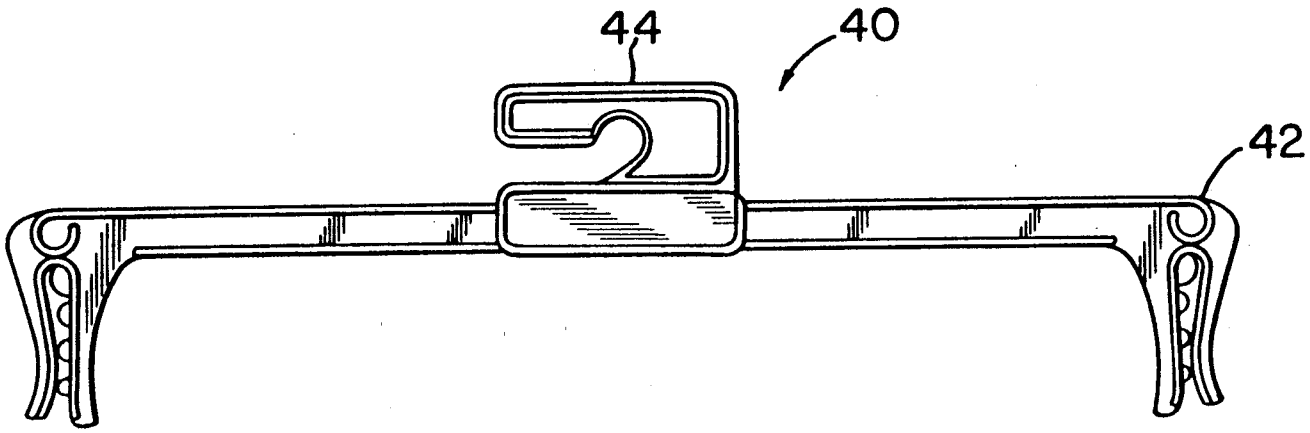
FIG. 5 is a front elevation of a third embodiment of a hanger in accordance with the invention.

A third embodiment of the invention is shown in FIGS. 5 and 6. Hanger 40 has wing portions, one being shown at 42, which differ from the wing portions of the first and second embodiments in including a set of four projections. Hanger 40 also differs in its hook portion 44, which is of a high density display variety. Considering wing portion 42, projections 46, 48, 50 and 52 are of generally arcuate configuration outwardly of the side margin, with projections 46, 48 and 50 being of successively lesser size progressively distal of hook portion 14 and with projection 52 being of size increased over projection 50. In this third embodiment, projection 46 is in excess of a semi-circle, projection 48 approximates a semi-circle, while projection 50 is a sector of a circle substantially less than a semi-circle and projection 52 is a larger circle sector than projection 50.

Considering wing portion 42, cantilever-supported member 54 defines mutually with projections 46, 48, 50 and 52 spacings of successively lesser measure progressively distal of hook portion 44.

As is seen in the enlarged partial view of FIG. 6, wherein panty 26 is shown supported by wing portion 42, panty 26 is found to bunch up in the upper area of the wing portion, based on the interaction of cantilever-supported member 54 and projections 46, 48, 50 and 52 as the panty is inserted into the wing portion. Projections 48 and 50 thereupon act as impediments to movement of the bunched up panty part downwardly and outwardly of the wing portion. Further retention is derived by the pinching action of member 54 and projections 46, 48, 50 and 52 on the panty.

In the third embodiment, the invention will be seen to provide a plurality of diversely-sized projections extending outwardly of the side margins, the plurality of projections including a succession of first projections of successively lesser size progressively distal of the hook portion and a further succeeding second projection of greater size than the immediately preceding projection in the succession, each wing portion comprising a member cantilever-supported by the central portion, each such cantilever-supported member defining spaces mutually with the projections. The spacings defined by the first projections and the cantilever-supported member are of successively lesser measure progressively distal of the hook portion. The spacing defined by the second projection and the cantilever-supported member is of substantially the same measure as the spacing defined by the immediately preceding projection and the cantilever-supported member.

Various changes to structure and modifications in practice may be introduced in the foregoing embodiments and practices without departing from the invention. Thus, the particularly discussed and depicted embodiments are intended in an illustrative and not in a limiting sense. The true spirit and scope of the invention is set forth in the following claims.

I claim:

1. A garment hanger comprised of an integral body of synthetic material having a central portion, a hook portion extending outwardly of said central portion and first and second wing portions at respective opposed side margins of said central portion, said central portion defining, at each said side margin thereof, a succession of diversely-sized projections extending outwardly of said side margins, said projections being of generally arcuate configuration and each of successively lesser size progressively distal of said hook portion, each wing portion comprising a member cantilever-supported by said central portion and therewith defining a slot for receiving a garment, each such cantilever-supported member defining mutually with said projections spacings of successively lesser measure progressively distal of said hook portion, one of said projections being disposed at an open end of said slot and another of said projections being disposed generally centrally in said slot.

2. The invention claimed in claim 1 wherein said succession of diversely-sized projections includes a first and a second projection, the first projection being of generally semi-circular configuration outwardly of said side margin.

3. The invention claimed in claim 2 wherein said second projection is generally of configuration comprising a sector of a circle substantially less than a semi-circle.

4. The invention claimed in claim 1 wherein said succession of diversely-sized projections includes first, second and third projections, the first projection being of generally semi-circular configuration outwardly of said side margin.

5. The invention claimed in claim 2 wherein said second projection is generally of configuration comprising a sector of a circle of dimension less than said first projection.

6. The invention claimed in claim 5 wherein a third projection is of configuration comprising a sector of a circle of dimension less than said second projection.

7. A garment hanger comprised of an integral body of synthetic material having a central portion, a hook portion extending outwardly of said central portion and first and second wing portions at respective opposed side margins of said central portion, said central portion defining, at each said side margin thereof, a plurality of diversely-sized projections extending outwardly of said side margins, said plurality of projections including a successive of first projections of successively lesser size progressively distal of said hook portion and a further succeeding second projection of greater size than the immediately preceding projection in said succession, each said wing portion comprising a member cantilever-supported by said central portion and therewith defining a slot for receiving a garment, each such cantilever-supported member defining spaces mutually with said projections, one of said projections being disposed at an open end of said slot and another of said projections being disposed generally centrally in said slot.

8. The invention claimed in claim 7 wherein the spacings defined by said first projections and said cantilever-supported member are of successively lesser measure progressively distal of said hook portion.

9. The invention claimed in claim 8 wherein the spacing defined by said second projection and said cantilever-supported member is of substantially the same measure as the spacing defined by said immediately preceding projection and said cantilever-supported member.

10. The invention claimed in claim 8 wherein said first projections comprise first, second and third projections, the first projection being of generally semi-circular configuration outwardly of said side margin.

11. The invention claimed in claim 11 wherein the second projection is generally of configuration comprising a sector of a circle substantially less than a semi-circle.

12. The invention claimed in claim 11 wherein said third projection is of configuration comprising a sector of a circle of dimension less than said second projection.

13. A garment hanger comprised of an integral body of synthetic material having a central portion, a hook portion extending outwardly of said central portion and first and second wing portions at respective opposed side margins of said central portion, said central portion defining, at each said side margin thereof, a plurality of diversely sized projections extending outwardly of said side margins, each said wing portion comprising a member cantilever-supported by said central portion and therewith defining a slot for receiving a garment, each such cantilever-supported member defining spaces mutually with said projections, one of said projections being disposed at an open end of said slot and another of said projections being disposed generally central in said slot.

14. The invention claimed in claim 13 wherein each said slot has an interior closed end at the junction of said central portion and said wing portion, said hanger including a further projection at said interior closed end of said slot.

* * * * *